US012313383B1

(12) United States Patent
Lathrom

(10) Patent No.: US 12,313,383 B1
(45) Date of Patent: May 27, 2025

(54) DEPLOYMENT SYSTEM AND METHODS OF MAKING AND USING SAME

(71) Applicant: Aaron Lathrom, Lawton, OK (US)

(72) Inventor: Aaron Lathrom, Lawton, OK (US)

( * ) Notice: Subject to any disclaimer, the term of this patent is extended or adjusted under 35 U.S.C. 154(b) by 0 days.

(21) Appl. No.: 18/377,698

(22) Filed: Oct. 6, 2023

Related U.S. Application Data

(60) Provisional application No. 63/413,771, filed on Oct. 6, 2022.

(51) Int. Cl.
*F41H 7/00* (2006.01)
*F42D 5/04* (2006.01)

(52) U.S. Cl.
CPC ..... *F41H 7/005* (2013.01); *F42D 5/04* (2013.01)

(58) Field of Classification Search
CPC ... F41H 7/00; F41H 7/005; F42D 5/04; F42D 5/00; F42D 5/045; F42D 5/02; F41B 9/0046
USPC ..... 86/50
See application file for complete search history.

(56) References Cited

U.S. PATENT DOCUMENTS

| | | | | |
|---|---|---|---|---|
| 7,896,113 | B1 * | 3/2011 | Ramirez | G05D 1/0038 180/9 |
| 8,434,991 | B1 * | 5/2013 | Hacker | B60P 1/6427 414/544 |
| 9,638,497 | B2 * | 5/2017 | Summer | B25J 3/00 |
| 10,247,526 | B2 * | 4/2019 | Burmeister | F41H 11/16 |
| 10,393,489 | B1 * | 8/2019 | Burmeister | F41H 11/28 |
| 2009/0294218 | A1 * | 12/2009 | Archer | B66F 9/065 901/1 |
| 2022/0227279 | A1 * | 7/2022 | Thrush | B60P 1/003 |
| 2023/0001956 | A1 * | 1/2023 | Langenfeld | B60P 1/6436 |

* cited by examiner

*Primary Examiner* — James S Bergin
(74) *Attorney, Agent, or Firm* — Hall Estill Law Firm

(57) ABSTRACT

A deployment system attachable to a vehicle for explosive ordnance disposal and methods of use thereof. Broadly, the deployment system includes a box assembly and a deployment assembly. The box assembly is mounted to one portion of the vehicle and the deployment assembly is mounted to another portion of the vehicle. The deployment system is used for deploying a robot.

20 Claims, 10 Drawing Sheets

DEPLOYMENT SYSTEM AND METHODS OF MAKING AND USING SAME

CROSS-REFERENCE TO RELATED APPLICATIONS

Figure 1A:
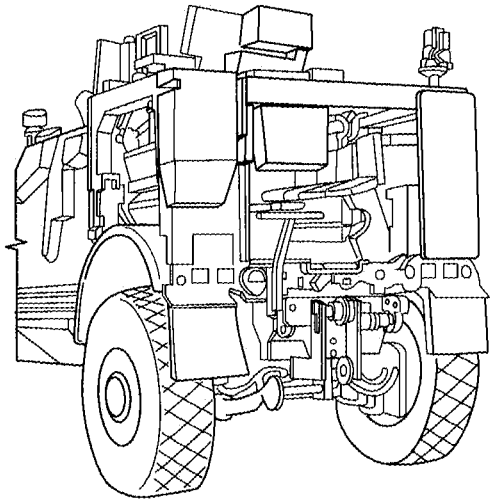
Figure 1B:
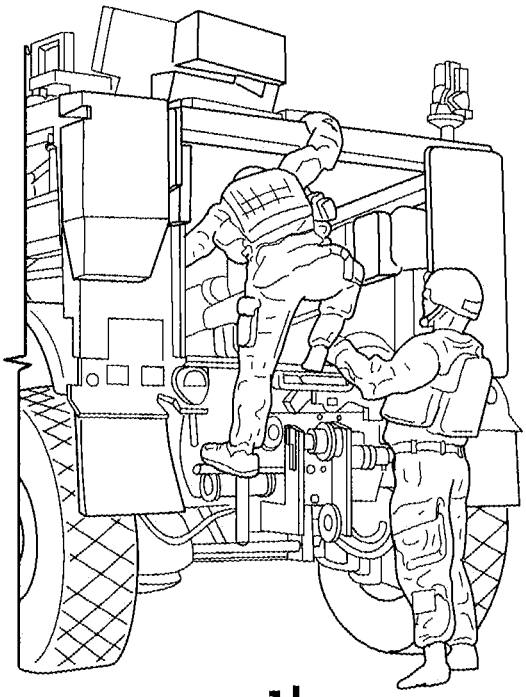
Figure 1C:
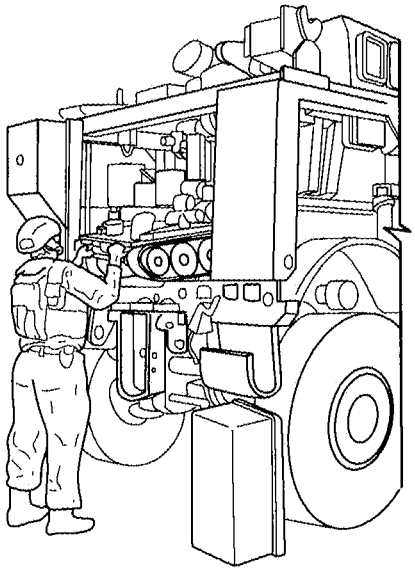
Figure 1D:
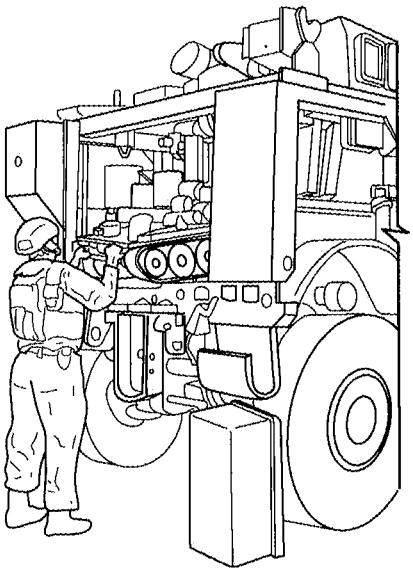
Figure 2A:
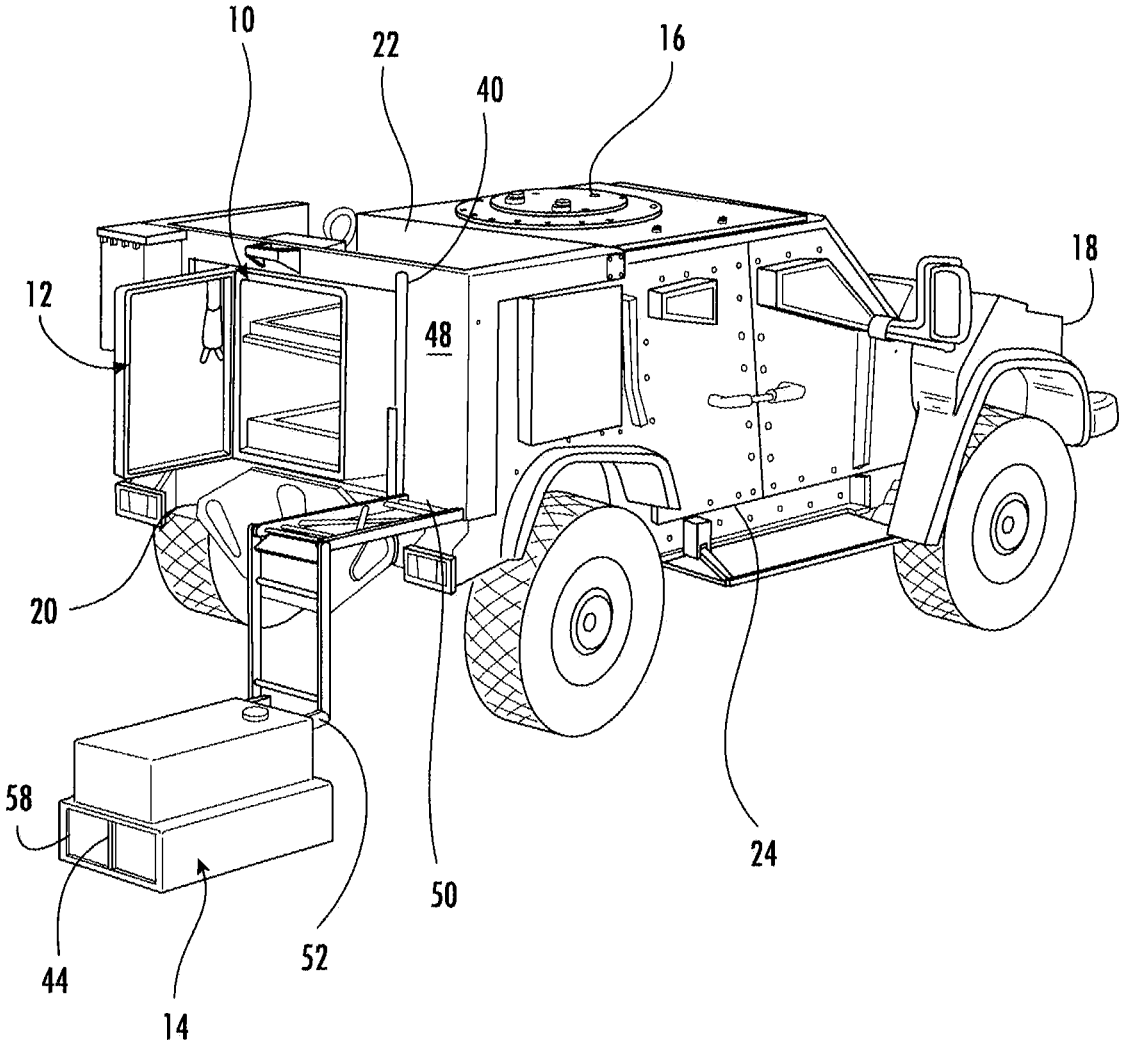
Figure 2B:
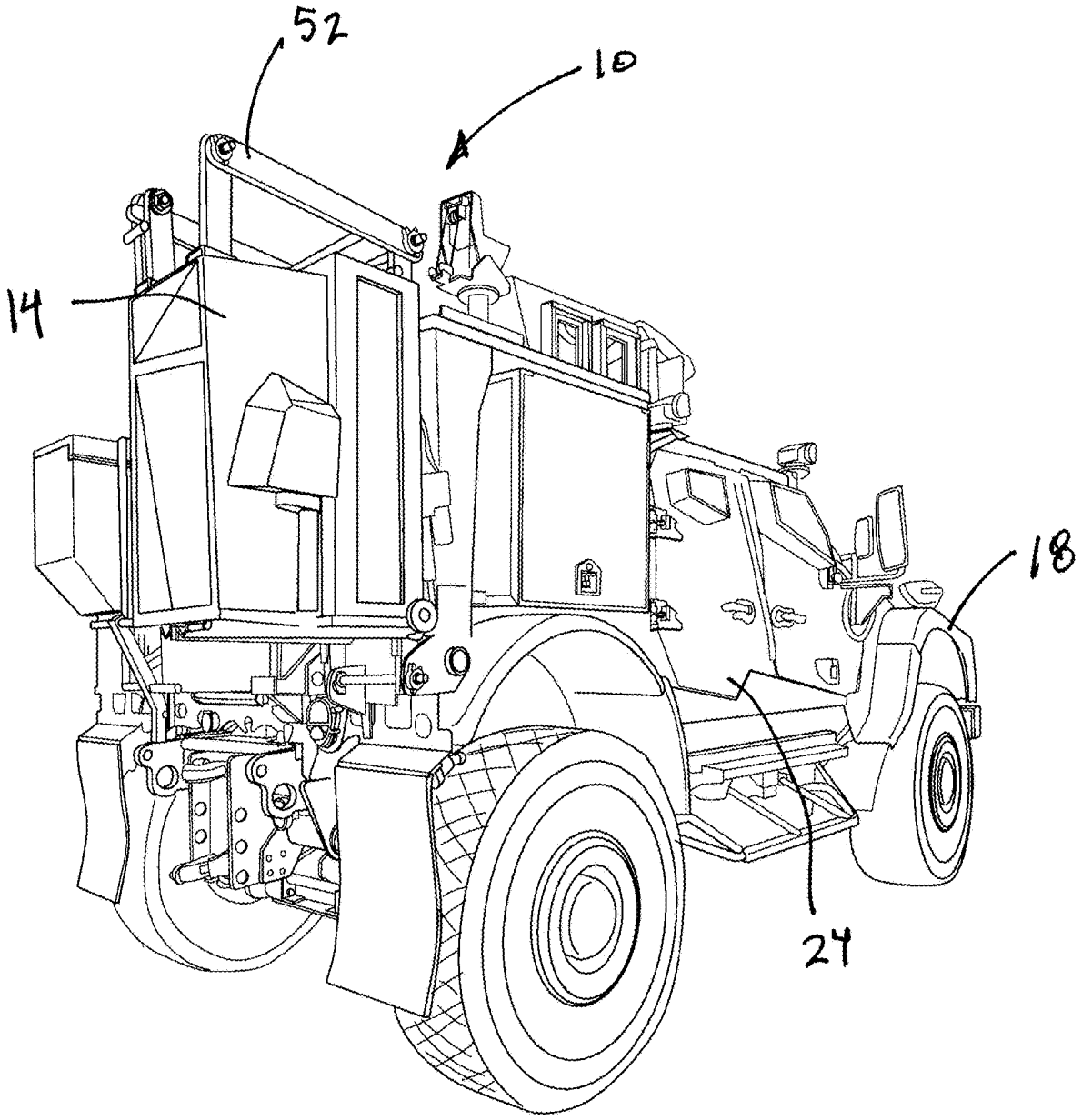
Figure 2C:
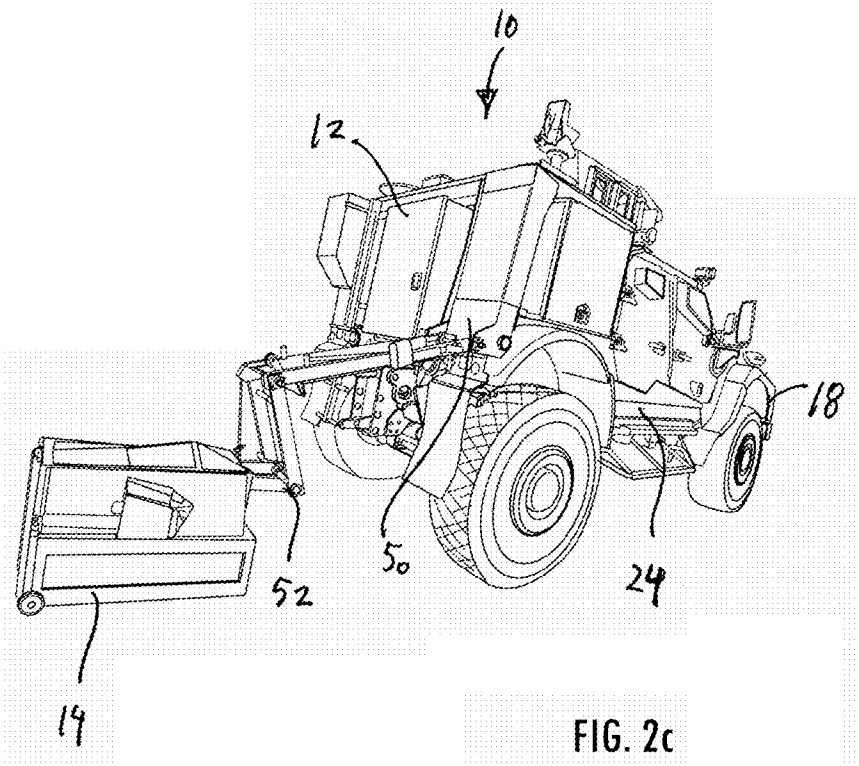
Figure 2D:
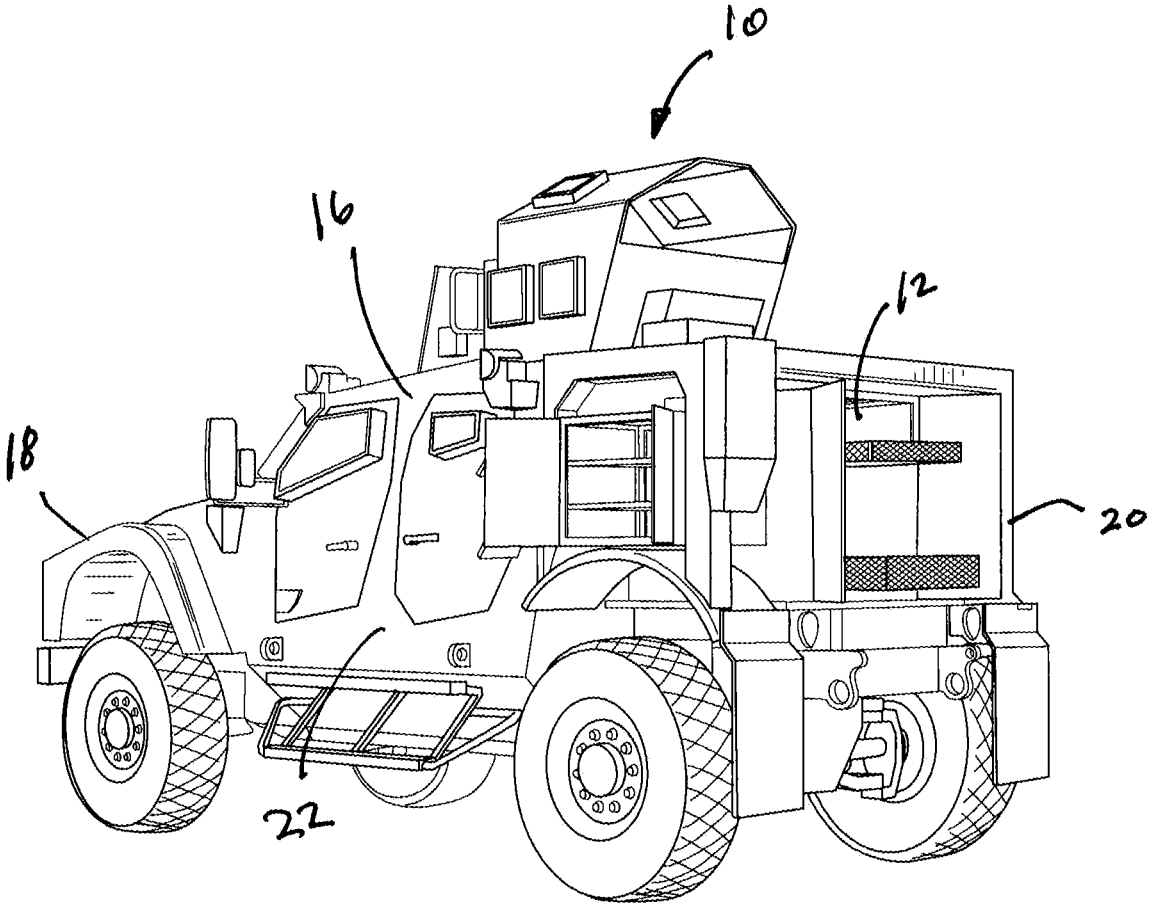
Figure 3A:
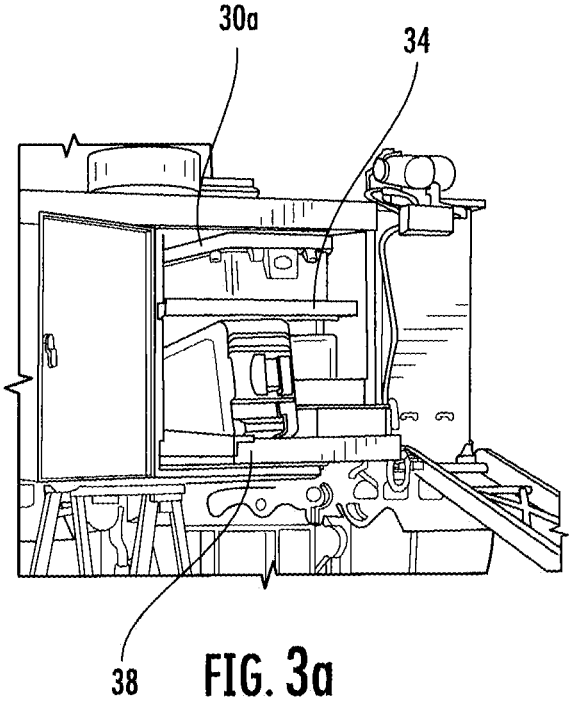
Figure 3B:
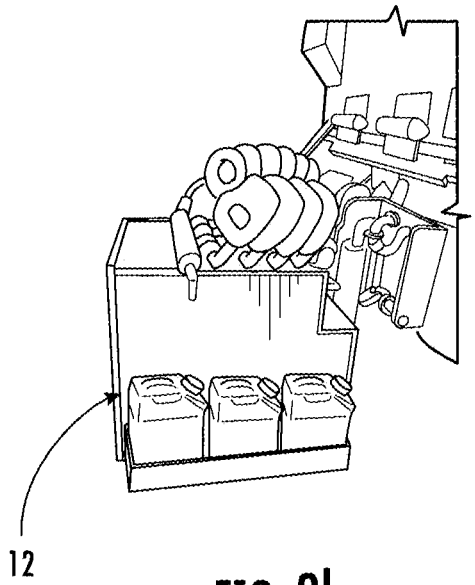
Figure 3C:
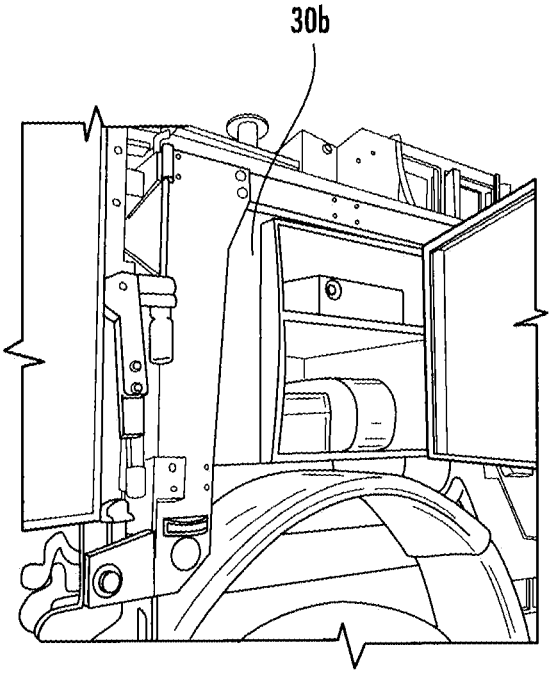
Figure 3D:
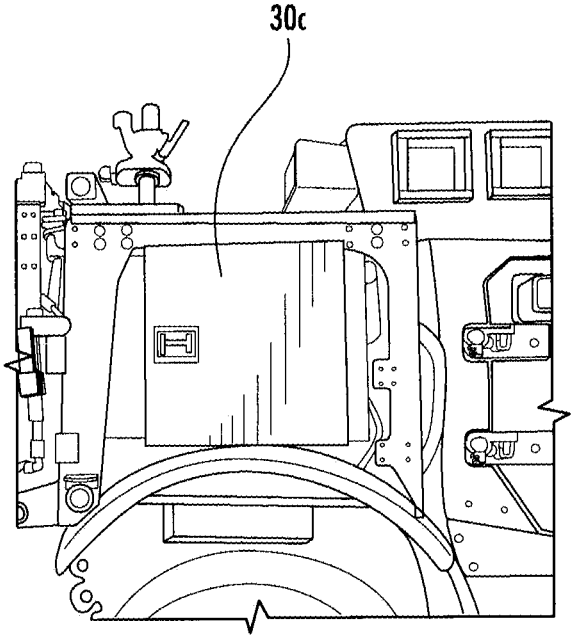

This application claims benefit under 35 U.S.C. 119 (e) of U.S. Provisional Application Ser. No. 63/413,771 filed Oct. 6, 2022, which is hereby expressly incorporated herein by reference in its entirety.

FIELD OF THE INVENTION

The present disclosure relates generally to equipment deployment systems, and more particularly, not by way of limitation, to a deployment system for explosive ordnance disposal.

BRIEF DESCRIPTION OF THE DRAWING(S)

FIGS. 1(*a*)-(*d*) are perspective views of a conventional system and method of deploying explosive ordnance disposal.

FIGS. 2(*a*)-(*d*) is a perspective view of one embodiment of a deployment system removably connected to a vehicle, the deployment system constructed in accordance with the present disclosure.

FIGS. 3(*a*)-(*d*) are perspective views of one embodiment of a box assembly constructed in accordance with the present disclosure.

Figure 4A:
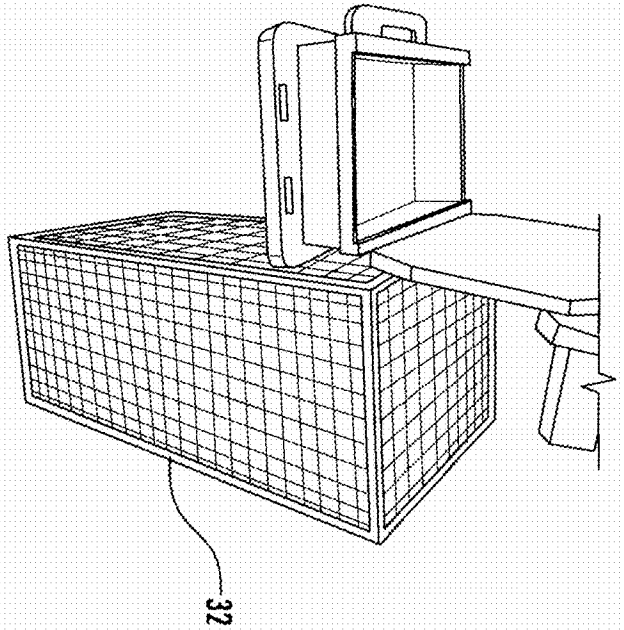
Figure 4B:
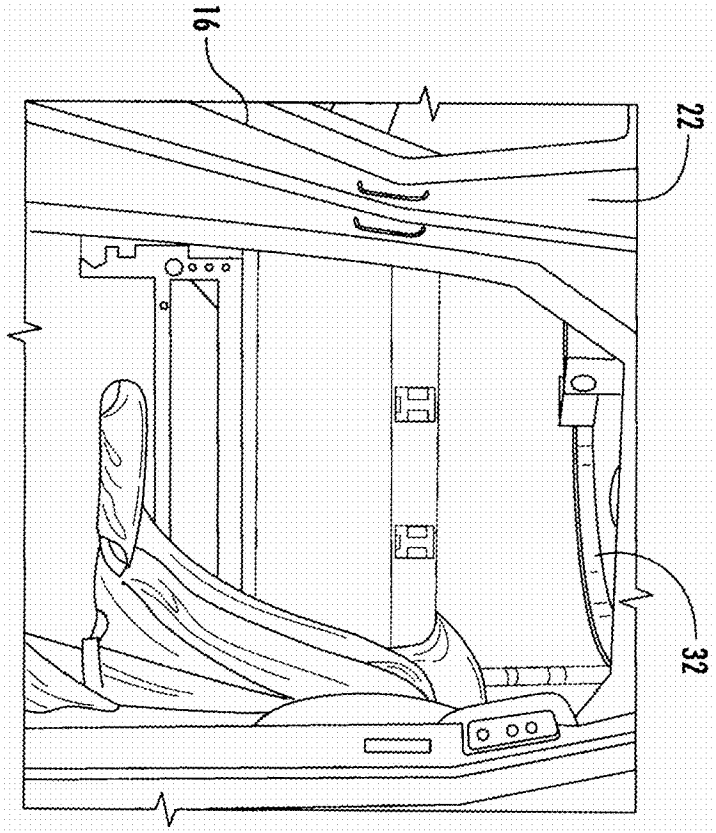
Figure 5A:
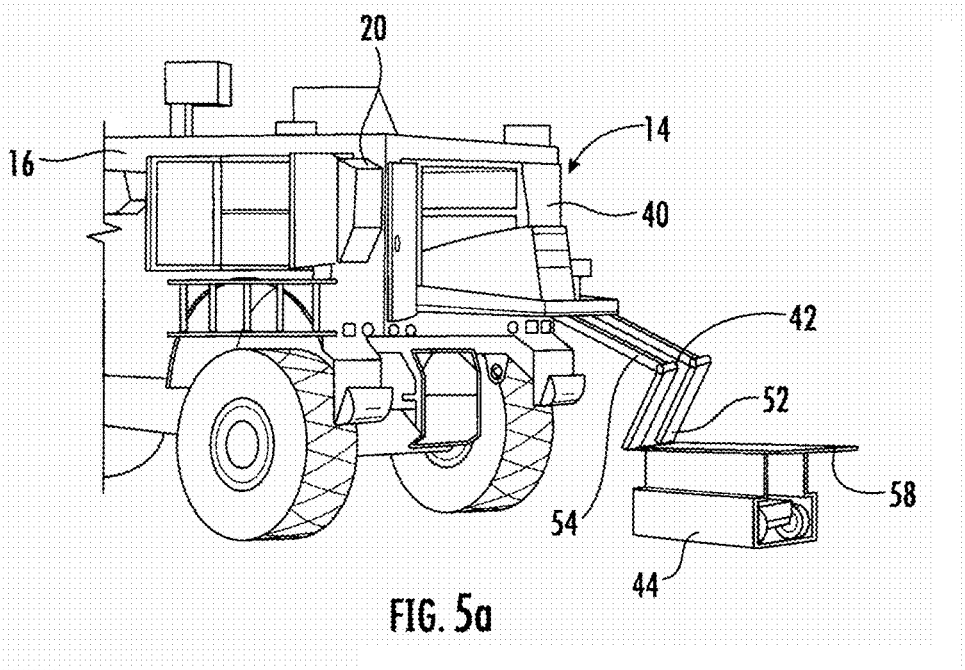
Figure 5B:
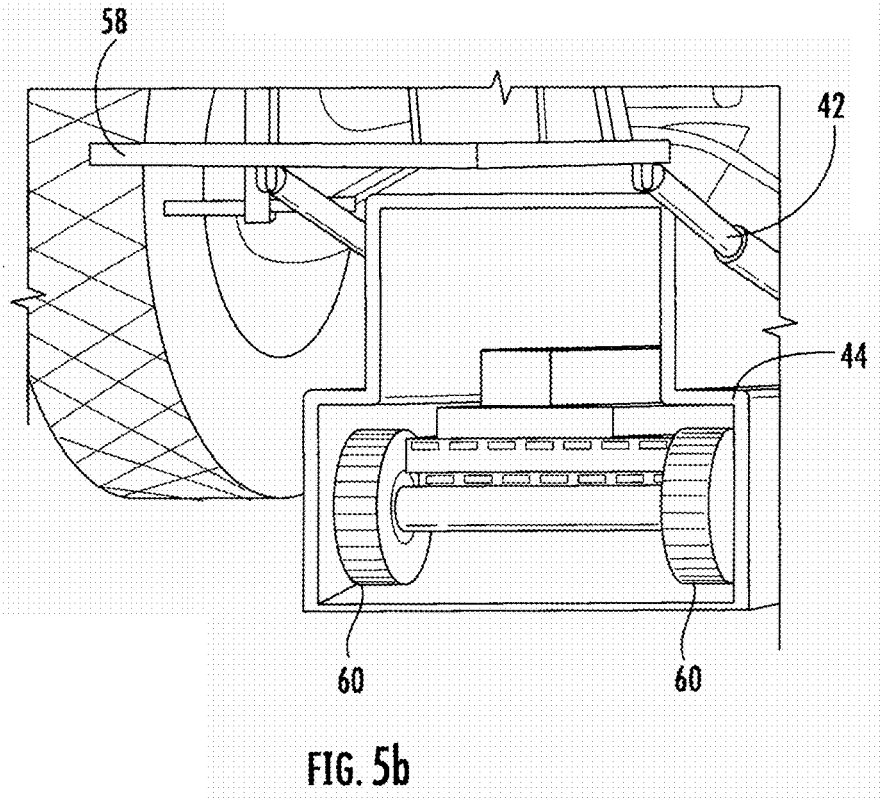
Figure 5C:
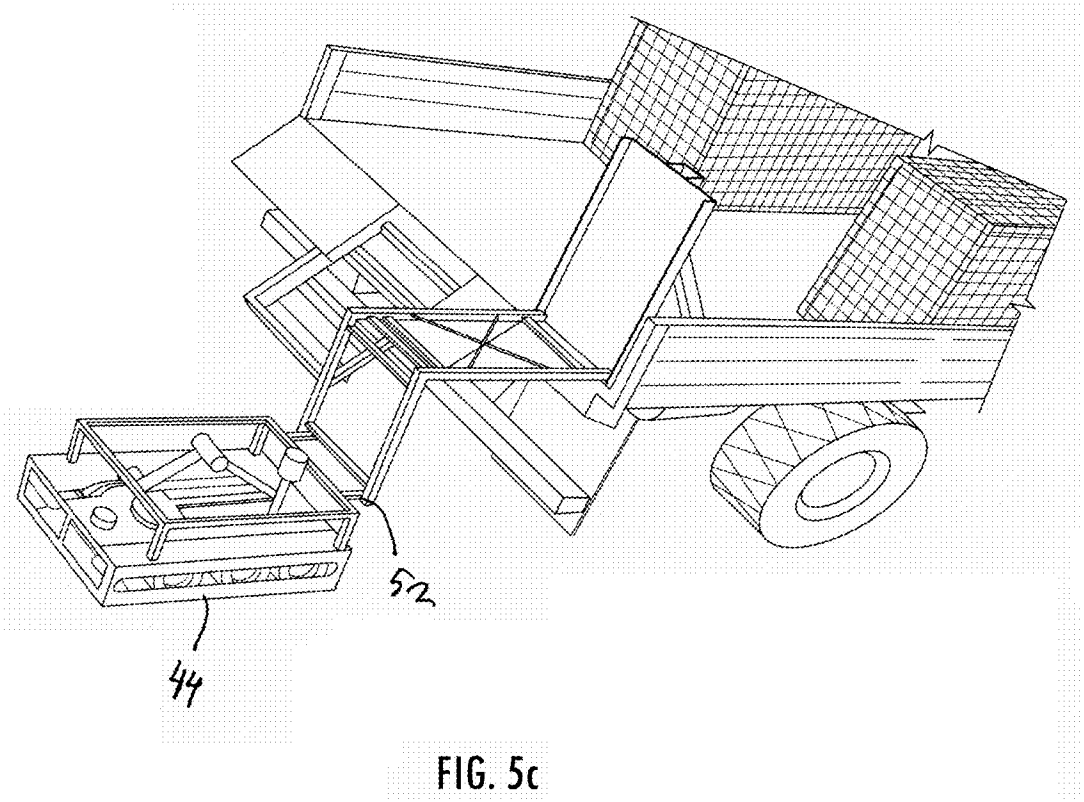
Figure 5D:
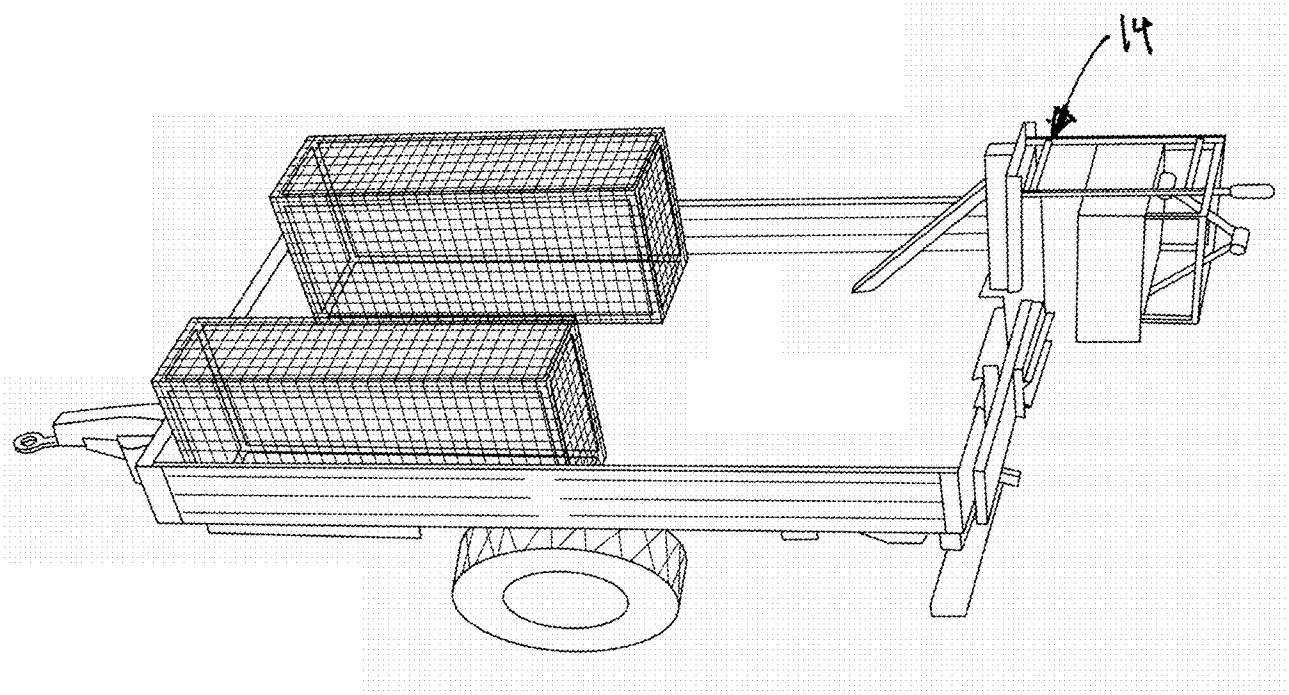

FIG. 4(*a*)-(*b*) is a perspective view of one embodiment of a cage assembly constructed in accordance with the present disclosure.

FIGS. 5(*a*)-(*d*) are perspective views of one embodiment of a robot deployment assembly constructed in accordance with the present disclosure.

BACKGROUND

Currently, primary vehicles used for explosive ordnance disposal (EOD) have little to no designated storage space having an open pit design. Referring to FIGS. 1(*a*)-(*d*), the available space is not designed for well-organized equipment. This leads to decrease in quantity of fielded equipment as well as lost or broken items.

It is very difficult to load and unload equipment even under non-combat conditions. The EOD robot is 150+ lbs and is usually buried under additional, very heavy equipment. In order to deploy the EOD robot, equipment must first be removed, then the robot can be retrieved with a two person lift. The full cycle for deploying the robot takes approximately 20 minutes. During this time, teams are exposed to enemy fire during the entire duration of deployment and a lengthy reverse operation to retrieve and prep for egress.

To this end, a need exists for a deployment system for explosive ordnance disposal than currently is provided in existing deployment systems. It is to such a device and method that the present disclosure is directed.

DETAILED DESCRIPTION OF THE INVENTION

Before explaining at least one embodiment of the inventive concept disclosed herein in detail, it is to be understood that the inventive concept is not limited in its application to the details of construction, experiments, exemplary data, and/or the arrangement of the components set forth in the following description, or illustrated in the drawings. The presently disclosed and claimed inventive concept is capable of other embodiments or of being practiced or carried out in various ways. Also, it is to be understood that the phraseology and terminology employed herein is for purpose of description only and should not be regarded as limiting in any way.

In the following detailed description of embodiments of the inventive concept, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, and more particularly to FIGS. 2(*a*)-(*d*), shown therein is one embodiment of a deployment system 10 constructed in accordance with the inventive concepts disclosed herein. It is contemplated that the deployment system 10 is constructed from various components and various materials, however, it should be understood that the deployment system 10 may be constructed from a single component or material. The deployment system 10 is preferably made of a durable and rigid material which is strong enough to prevent damage to the components stored in the deployment system 10. Suitable materials for construction of all or part of the deployment system 10 and components thereof include polymeric materials, plastics, metals such as aluminum, steel, titanium, magnesium or alloys containing these metals, and composite materials, wood, rubber, foam, iron, and the like which are capable of providing the desired strength and durability for the deployment system 10. Further, it should be understood that various methods known in the art may be utilized for constructing and manufacturing the various embodiments of the deployment system 10 as described and shown herein.

The system 10 includes a box assembly 12 and a deployment assembly 14 mounted to a conventional all-terrain vehicle 16 having a front end 18, a rear end 20 and sides 22 and 24. Although the vehicle 16 is shown herein utilized with the system 10, it should be understood by one of ordinary skill in the art that a variety of vehicles, such as Mine Resistant Ambush Protected All-Terrain Vehicles (MATV), Joint Light Tactical Vehicles (JLTV), or the like may be utilized with the system 10 so long as the system 10 operates as described herein. It should be understood by one of ordinary skill in the art that the box assembly 12 and the deployment assembly 14 may be utilized separately and together in conjunction with various vehicles.

Referring to FIGS. 3(*a*)-(*d*) and FIGS. 4(*a*)-(*b*), in one embodiment, the box assembly 12 includes at least one box 30 and a cage 32. The at least one box 30 is weather tight and includes a top drawer 34 and a bottom drawer 36. It will be understood that the box 30 may be configured in any variety of shapes so long as the at least one box 30 performs and functions as described herein. The at least one box 30 is shown removably connected to and positioned in the vehicle 16. Additionally, a plurality of boxes 30*a* and 30*b* may be utilized with the system 10 and may be configured in various ways so as to be connectable to or positionable in or about the vehicle 16. As shown, in one configuration, a box 30*a* is connected toward the rear end 20 of the vehicle 16, a box 30*b* is connected on one side 22 of the vehicle 16 and a box 30*c* is connected on the opposite side 24 of the vehicle 16.

In one embodiment, the top drawer 34 of the at least one box 30 has a weight capacity of about 350 lbs. The bottom drawer 36 has a weight capacity of about 600 lbs and can hold an EOD robot. The at least one box 30 is compatible with all EOD equipment. Additional capabilities of the at least one box 30 are as follows: top-mount storage for cots, rucks and a team tent, side-mount equipment rack can safely handle 3 Jerry cans, folding Ladder, light-weight & heavy-duty, provides reach for gear stowed high and deep, combined total capacity is over 300 lbs (150 lbs per unit), aluminum construction, weatherproofed and capable of storing a wide range of equipment, MREs and potable water, individual team gear, equipment cases as required, shelves are mission configurable and removable, side mounted ladder that easily detaches allowing team to safely and quickly access as needed.

In some embodiments, the box 30 offers about 105 cu. ft. of efficient storage which does not currently exist. The box 30 provides easy, bolt-in installation such that no vehicle modifications are required. The modular configuration of the box 30 works with both Mine Resistant Ambush Protected All-Terrain Vehicles (MATV) and Joint Light Tactical Vehicles (JLTV). The box 30 is weather tight and harsh environment rated. The box 30 design adds minimal weight to the vehicle platform.

The cage 32 is positioned in the cabin of the vehicle 16. The cage 32 may be configured in various shapes and constructed of durable materials, as disclosed herein. The cage 32 is adjustable and used to store various equipment, such as EOD kit, batteries, computers and any other necessary equipment. The cage 32 may be locked to keep the stored equipment contained in the event of a roll-over of the vehicle or travel over rough terrain. In some embodiments, the cage 32 is provided with a detachable shelf suitable to store sensitive items as well as offering a flat work surface. Additionally, the cage 32 may be provided with an adjustable position laptop mount.

In some embodiments, the cage 32 offers 5 cu. ft. of organized in-cabin storage. The cage 32 increases utility of cabin space not realized in OEM design. The cage 32 secures loose equipment in vehicle and reduces potential injury in case of roll over of the vehicle 16.

Referring now to FIGS. 5(*a*)-(*d*), in one embodiment, the deployment assembly 14 includes a base 40, an arm 42 and a container 44. The base 40 has a first side 46 and a second side 48 wherein the first side 46 is configured to be connectable to the rear end 20 of the vehicle 16 and the second side 48 is configured to secure the container 44 when not in use.

The arm 42 has a first end 50, a second end 52 and a foldably retractable portion 54 therebetween. The first end 50 of the arm 42 is connected to the second side 48 of the base 40. The second end 52 is connected to the container 44. The container 44 is sized and configured to define an EOD robot space 56 for receiving any EOD robot.

The arm 42 is movable between an extended, deployed position and a retracted, stored position when not in use. When moving the arm assembly 14 into a deployed position, the arm 42 is movably extended a distance from the base 40 of the deployment assembly 14 so that the container 44 is positioned on a ground surface. The container 44 has a door 58 that is opened so that an EOD robot 60 is deployed for EOD.

When moving the arm 42 to a stored position, the arm 42 is foldably retracted so that the container 44 is positioned on the base 40 and secured in place.

The deployment assembly 14 is a modular system capable of being configured to be compatible with a wide range of vehicles in the military's current inventory. The deployment assembly 14 may be remotely operated from within the cabin of the vehicle 16. Systems and methods for remotely operating elements are known in the art. It should be understood by one of ordinary skill in the art that any system of method may be used for remotely operating the deployment assembly 14. Thus, no further description is believed necessary so long as the remote system and method function in accordance with the present disclosure as described herein.

LED position indicators and limit switches are provided and a multi-angle camera system is included to allow for eyes-on the deployment assembly 14 at all times. The deployment assembly 14 is provided with the appropriate field oriented design features and a self-locking mechanism for securing the deployment assembly 14 and robot safely to the vehicle while in transit. The deployment assembly 14 is over-built for heavy use within an operational envelope and can deploy with a manual back up kit. Further, it is field serviceable with basic hand tools and fits all previous EOD robots and new MTRS. The deployment assembly 14 is also adaptable to future iterations.

In various embodiments, the present disclosure is directed to a deployment system connectable to a vehicle. One objective of one embodiment of the deployment system is to optimize unit battlefield readiness by increasing functional storage space for common DoD platforms, increasing unit self-sufficiency when outside friendly resupply zones and providing capability where none currently exists.

Another objective of one embodiment of the deployment system 10 is to improve the human-unmanned system interface for EOD personnel by reducing casualties by minimizing direct exposure to enemy fire and reduce time on target for personnel in hostile locations, improving robotic system deploy and capture process to reduce number of required personnel and time required to execute, and reducing impact/injury to body from weight of robotics platform. The deployment system 10 reduces time on target from about 20 min to less than about 3 min (EOD robotic deployment), reduces chances of injury from loading unloading gear at excessive heights and in tight spaces, is a force multiplier-enables each vehicle to be a fully self-contained team, has combined systems capable of handling over 1750 LBS of equipment, safely, efficiently and in less time.

The future potential of the deployment system 10 includes: the box is adaptable to many platforms such as in-country vehicles (Toyota Hilux), small off-road vehicles (Polaris Razer), as well as the new Infantry Squad Vehicle (ISV) and Joint Light Tactical Vehicle (JLTV), enhanced capabilities for current and future forward deployed teams including air-dropped assets, human-machine interface, rapid EOD robot deployment, now performed by one rather than two personnel, reduction of time on target from 20 min to less than 3 min Deploy, load and stow, improvement of over 85%.

The deployment system 10 of the present disclosure is a fundamental change in the approach of EOD for EOD and deployed forces. The deployment system 10 increases personnel safety by reducing exposure to hazards from exiting vehicle to load and unload robot and acquire certain tools from inside of vehicle that can now be stored in shark cage and reduction of injury from lifting excessively heavy gear and equipment. 65% of all non-combat injuries in the military are Musculoskeletal. 85% of non-combat related medically evacuated military members never return to the theater. The deployment system 10 increases combat effectiveness and overall readiness and significant attrition of lost training and injury exposure risk factors, increase organized storage from about 12 cu. ft. to about 105 cu. ft., increases EOD mobility and capabilities, allows safe storage of equipment inside of vehicle, and the modular system easily adapts to additional vehicle platforms and associated equipment. It should be understood that changes may be made in the operation and the setup of any portion of any embodiments of the deployment system disclosed herein.

From the above description, it is clear that the inventive concept(s) disclosed herein is well adapted to carry out the objects and to attain the advantages mentioned herein as well as those inherent in the inventive concept disclosed herein. While exemplary embodiments of the inventive concept disclosed herein have been described for purposes of this disclosure, it will be understood that numerous changes may be made which will readily suggest themselves to those skilled in the art and which are accomplished without departing from the scope of the inventive concept disclosed herein and defined by the appended claims.

What is claimed is:

1. A deployment system attachable to a vehicle for explosive ordnance disposal, the system comprising:

a box assembly mounted to a portion of the vehicle, the box assembly having at least one box having a top drawer and a bottom drawer; and a deployment assembly mounted to a portion of the vehicle for deploying an explosive ordnance disposal robot, the deployment assembly, comprising:

a base having a first side and a second side, the first side configured to be connectable to a rear end of the vehicle and the second side configured to secure, an arm having a first end, a second end and a foldably retractable portion therebetween, the first end of the arm being connected to the second side of the base; and sized and configured to define an explosive ordnance disposal robot space for receiving the explosive ordnance disposal robot, the container having a closed end and an open end wherein the container being connected to the second end of the arm.

2. The deployment system of claim 1 wherein the at least one box is positioned on a back of the vehicle.

3. The deployment system of claim 1 wherein the at least one box is positioned on a side of the vehicle.

4. The deployment system of claim 1 wherein the at least one box is configured such that the inside of the box is protected from weather.

5. The deployment system of claim 1, the box assembly further comprising:

a cage positioned in a cabin of the vehicle, the cage configured to store various equipment.

6. The deployment system of claim 1 wherein the arm is movable between a deployed position and a stored position wherein when moving the arm into a deployed position, the arm is movably extended a distance to unfold the arm from the base of the deployment assembly so that the container is positioned on a ground surface, wherein when moving the arm to the stored position, the arm is movably folded toward the base of the deployment assembly such that the container is lifted off the ground and positioned against the rear of the vehicle.

7. The deployment system of claim 6 wherein in the deployed position, the container is horizontally positioned allowing ingress and egress from the open end of the container.

8. The deployment system of claim 1 wherein the container has a door covering the open end.

9. The deployment system of claim 1 having a multi-angle camera for monitoring the deployment system.

10. A deployment system, the system comprising:

a vehicle used for explosive ordnance disposal; and a deployment assembly mounted to a rear of the vehicle for deploying an explosive ordnance disposal robot, the deployment assembly, comprising:

a base having a first side and a second side, the first side configured to be connectable to a rear end of the vehicle and the second side configured to secure, an arm having a first end, a second end and a foldably retractable portion therebetween, the first end of the arm being connected to the second side of the base; and sized and configured to define an explosive ordnance disposal robot space for receiving the explosive ordnance disposal robot, the container having a closed end and an open end wherein the container being connected to the second end of the arm.

11. The deployment system of claim 10 wherein the arm is movable between a deployed position and a stored position wherein when moving the arm into a deployed position, the arm is movably extended a distance to unfold the arm from the base of the deployment assembly so that the container is positioned on a ground surface, wherein when moving the arm to the stored position, the arm is movably folded toward the base of the deployment assembly such that the container is lifted off the ground and positioned against the rear of the vehicle.

12. The deployment system of claim 11 wherein in the deployed position, the container is horizontally positioned allowing ingress and egress from the open end of the container and in the stored position the container is vertically positioned.

13. The deployment system of claim 10 wherein the container has a door covering the open end.

14. The deployment system of claim 10 having a multi-angle camera for monitoring the deployment system.

15. The deployment system of claim 10, further comprising:

a box assembly mounted to a portion of the vehicle, the box assembly having a plurality of boxes, wherein each of the plurality of boxes has at least one drawer.

16. The deployment system of claim 15 wherein at least one of the plurality of boxes is positioned on a back of the vehicle.

17. The deployment system of claim 15 wherein at least one of the plurality of boxes is positioned on a side of the vehicle.

18. The deployment system of claim 15 wherein the plurality of boxes is configured such that the inside of the box is protected from weather.

19. The deployment system of claim 15, the box assembly further comprising:

a cage positioned in a cabin of the vehicle, the cage configured to store various equipment.

20. The deployment system of claim 10 wherein the vehicle is an all-terrain vehicle.

* * * * *